United States Patent [19]

Lin

[11] Patent Number: 4,903,179

[45] Date of Patent: Feb. 20, 1990

[54] INDOOR/OUTDOOR LIGHT DECORATION

[75] Inventor: Ling-Yung Lin, Taipei, Taiwan

[73] Assignee: New Feilien Ent. Co., Ltd., Taipei, Taiwan

[21] Appl. No.: 397,251

[22] Filed: Aug. 23, 1989

[51] Int. Cl.[4] ..... F21V 15/00

[52] U.S. Cl. ..... 362/184; 362/248; 362/249; 362/252

[58] Field of Search ..... 362/145, 184, 248, 249, 362/252

[56] References Cited

U.S. PATENT DOCUMENTS

| | | | |
|---|---|---|---|
| 3,104,064 | 9/1963 | Bellek | 362/267 |
| 3,714,414 | 1/1973 | Sternius | 362/249 |
| 4,072,857 | 2/1978 | DeVicaris | 362/252 |
| 4,177,503 | 12/1979 | Anquetin | 362/249 |
| 4,521,839 | 6/1985 | Cook | 362/249 |
| 4,598,339 | 7/1986 | Ainsworth | 362/184 |

FOREIGN PATENT DOCUMENTS

| | | | |
|---|---|---|---|
| 54480 | 4/1979 | Japan | 362/252 |

*Primary Examiner*—Douglas Hart
*Attorney, Agent, or Firm*—Karl W. Flocks

[57] ABSTRACT

The present disclosure is related to an indoor/outdoor light decoration asssembly operable by either AC or DC power source, including a number of light strings sealedly disposed in corresponding transparent tubular holders which are well guarded against rain or snow. The tubular holders are electrically associated in parallel; and a battery box having a pair of strings of female sockets connected to each other in parallel extended therefrom so that the male plugs disposed at the end of the light strings can be engaged therewith. The present article is provided with a pointed ground fixing member and a support base which is selectively engaged with the former so that the present light decoration assembly can also be placed in any indoor/outdoor places as desired. The tubular holders are detachably secured onto a number of corresponding fixing mounts which can also be used to support electrically operated candle stick and various forms of light conductive articles made of optical fibers or other light transmitting materials. The battery box provided with a number of selection buttons and an adapter jack is used as a power source whereby the present light strings can be selectively operated in a steady burning state or in a one way flash state, or can be controlled to switch on or off by CDS or manually, and be operated in AC or DC. Moreover, the transparent tubular holders are made to have a plurality of axially disposed ribs, extending the full length thereof so that light can be better transmitted through the transparent tubular holders.

7 Claims, 6 Drawing Sheets

INDOOR/OUTDOOR LIGHT DECORATION

FIELD OF THE INVENTION

The present invention is related to an indoor/outdoor light decoration assembly including a number of transparent tubular holders which are readily planted onto the ground by way of a number of associated pointed ground fixing members. Each tubular holder is used to contain a string of lights commonly used on Christmas occasion, which are well sealed against rain or snow in the transparent tubular holders; and the illumination through the same can produce splendid decoration effect; 3 or more tubular holders are electrically coupled to each other in parallel; a pair of strings of female sockets are extended from a battery box which is provided with a number of control buttons so as to vary the operational states of the light strings, i.e., in a steady burning state or one way flash state; and to determine the light strings to be operated automatically by CDS or by an on/off switch; and an adapter jack which enables the present invention to be operated in either AC or DC.

Furthermore, the present invention adopts a number of tubular fixing mounts to which the tubular members can be removably attached respectively, or a number of light conductive articles made of optical fibers or other light transmitting materials can be secured, or a number of electrically operated candles can be attached with ease. Moreover, the transparent tubular members are provided with a plurality of spaced ribs, extending axially the full length thereof so that the illumination effect can be better achieved. In addition, a support base which is able to be removably engaged with each pointed ground fixing member enables the present invention to be erected on the indoor floor.

SUMMARY OF THE INVENTION

The primary object of the present invention is to provide an indoor/outdoor light decoration assembly which comprises of a number of transparent tubular holders each having a string of parallelly connected light bulbs contained therein; and a battery box having a pair of extended strings of sockets is used to provide electric connection to those strings of lights.

One other object of the present invention is to provide an indoor/outdoor light decoration assembly which comprises of a number of transparent tubular holders which are well guarded against penetration of rain or snow so that they can be exposed to the outdoor field in bad weather and especially in snowing Christmas season.

One further object of the present invention is to provide an indoor/outdoor light decoration assembly which comprises of a number of tubular fixing mounts onto which a corresponding number of the tubular holders or electrically operated candle sticks or light conductive objects made of optical fibers of other light transmitting materials can be secured for decoration purpose.

One still further object of the present invention is to provide an indoor/outdoor light decoration assembly which adapts commonly known light strings for Christmas decoration use so that the maintenance thereof can be effected with ease, and even with one light bulb of a light string out of order, the normal operation thereof can be kept without interruption.

One still further object of the present invention is to provide an indoor/outdoor light decoration assembly which is operated either in AC or DC, and a battery box equipped with a number of selection buttons and an adopter jack permits the light decoration assembly to be selectively operated in a steady burning state or one way flash state and to be controlled to turn on and off either by CDS or manually; and an AC power source can be applied through the adapter jack.

One still further object of the present invention is to provide an indoor/outdoor light decoration assembly wherein the transparent tubular holders are made to have a plurality of spaced axially-disposed ribs, extending the full length thereof, so that light can be better transmitted therethrough.

One still further object of the present invention is to provide an indoor/outdoor light decoration assembly wherein the pointed ground fixing member can be removably engaged with a support base having a round flat bottom so that the assembly can be located at any place inside a house.

DETAILED DESCRIPTION OF PREFERRED EMBODIMENT

Figures 1, 1A, 1B:
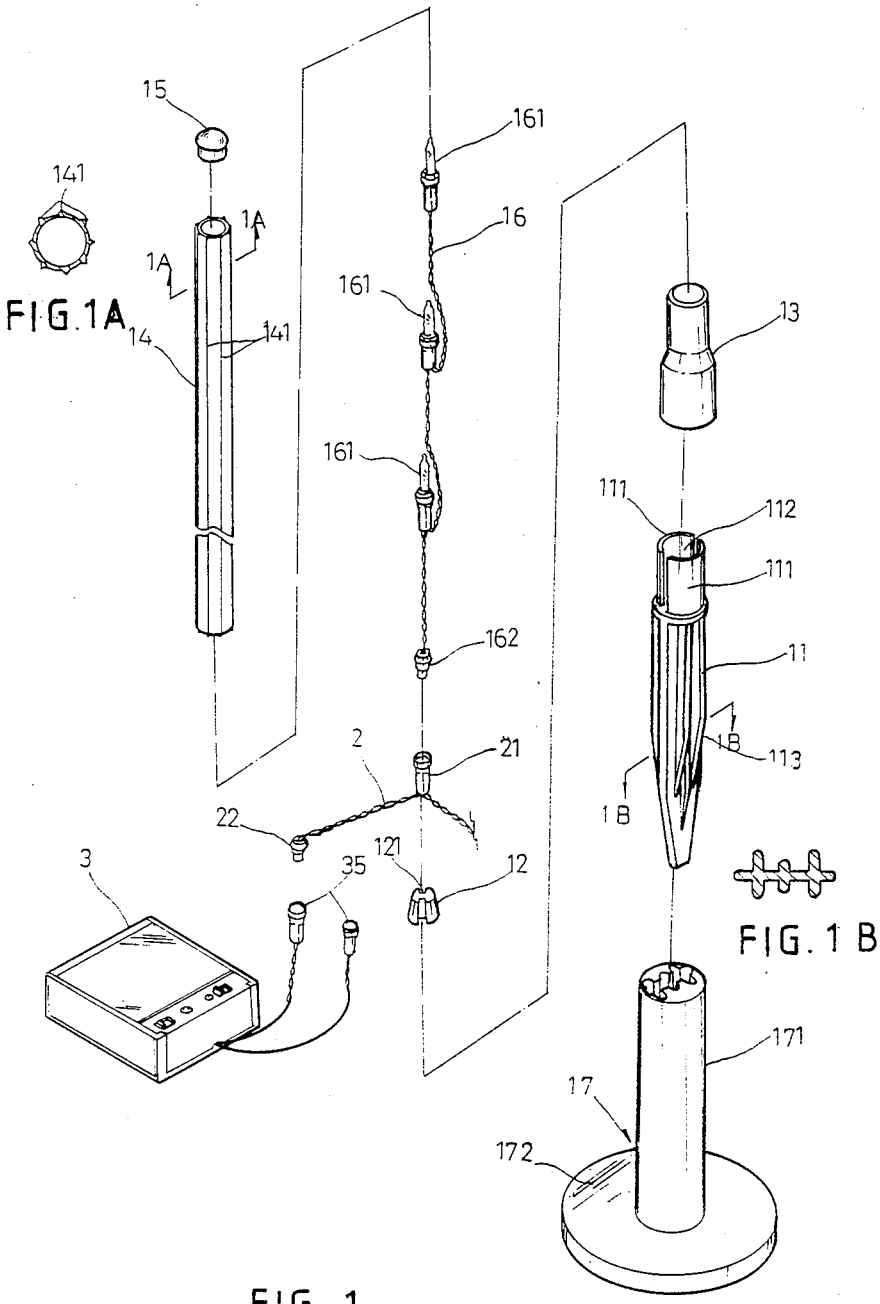
FIG. 1 is a diagram showing the exploded components of the present invention.
FIG. 1A is a sectional view of the transparent tubular holder, taken along the line 1A—1A of FIG. 1.
FIG. 1B is a sectional view of the pointed ground fixing member, taken along the line 1B—1B of FIG. 1.
Figure 3:
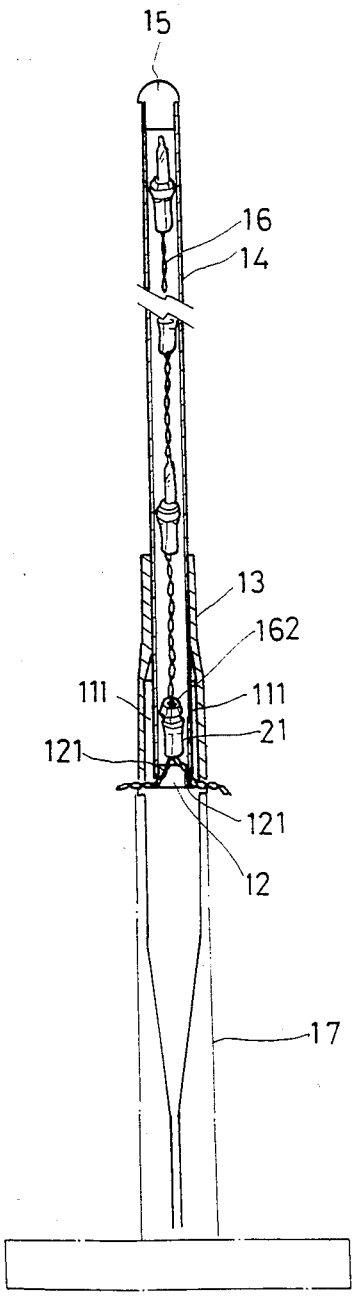
FIG. 3 is a sectional view of FIG. 2 with a support base associated with the ground fixing member.

Referring to FIG. 1, the present indoor/outdoor light decoration assembly comprises a number of light strings 16 which have been commonly used for decoration of Christmas trees or the like; each light string 16 is housed in a transparent tubular holder 14 which is secured in place by way of a tubular fixing mount 13 in connection with a pointed ground fixing member 11. Each end of the light strings is provided with a male plug 162 which is detachably engaged with one of a umber of female sockets 21 electrically connected to each other in parallel. The female sockets 21 are preferrably connected to each other 3 as a group.

Figure 2:
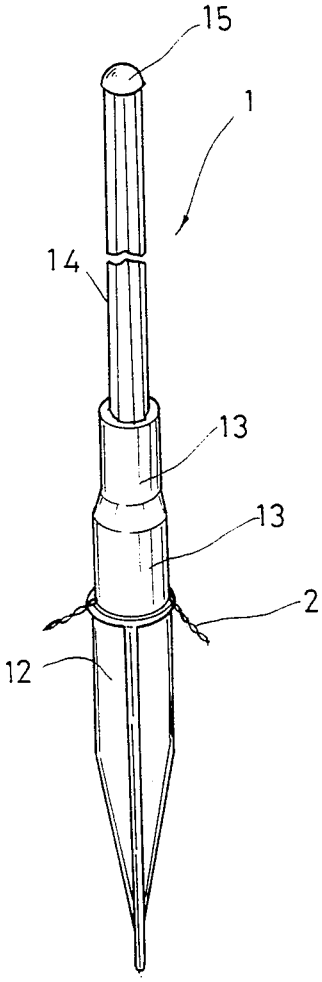
FIG. 2 is a diagram showing the tubular holder engaged with a pointed ground fixing member.

As shown in FIG. 1A and 2, each transparent tubular holder 14 of the present invention is defined to have a plurality of spaced axially oriented ribs 141, extending the full length thereof, thereby the light produced by the light string 16 can be outwardly shed in a more splendid manner.

Each tubular holder 13 is secured in place by engagement with a tubular fixing mount 13 having two sections with different diameters, which is coupled to the pointed ground fixing member 11. The top end of the ground fixing member 11 is provided with a cylindrical protrusion having a pair of symmetric splits 112 disposed on the wall thereof so to permit the passage of electric wires 2 which are engaged with the bottom seal cover 12 of the transparent tubular holders 14 after the male plug 162 of the light string 16 is engaged with the female socket 35.

As shown in FIGS. 1, 1A, each transparent tubular holder 14 is equipped with a top cap 15 defined in a mushroom shape, which is tightly engaged with the top opening of the tubular holder 14 thereby rain or snow water hit thereon will be guided to move along the peripheral flange thereof and drop to the ground directly without touching the peripheral edge of the tubular holder so as to prevent water from entering the same. The light string 16 consisting of a number of parallelly connected light bulbs 161 with a male plug 162 disposed at the terminal end thereof is located within the transparent tubular holder 14. The male plug 162 is then engaged with one of the parallelly connected female sockets 35. The engaged socket 35 is stuffed into the bottom end of the tubular holder 14 with the seal cover 12 having a pair of symmetric vertical grooves 121 disposed at the periphery thereof, thereby electric wires can be engaged therewith as the seal cover 12 is pressed into the tubular holder 2 in assembly.

Figure 7:
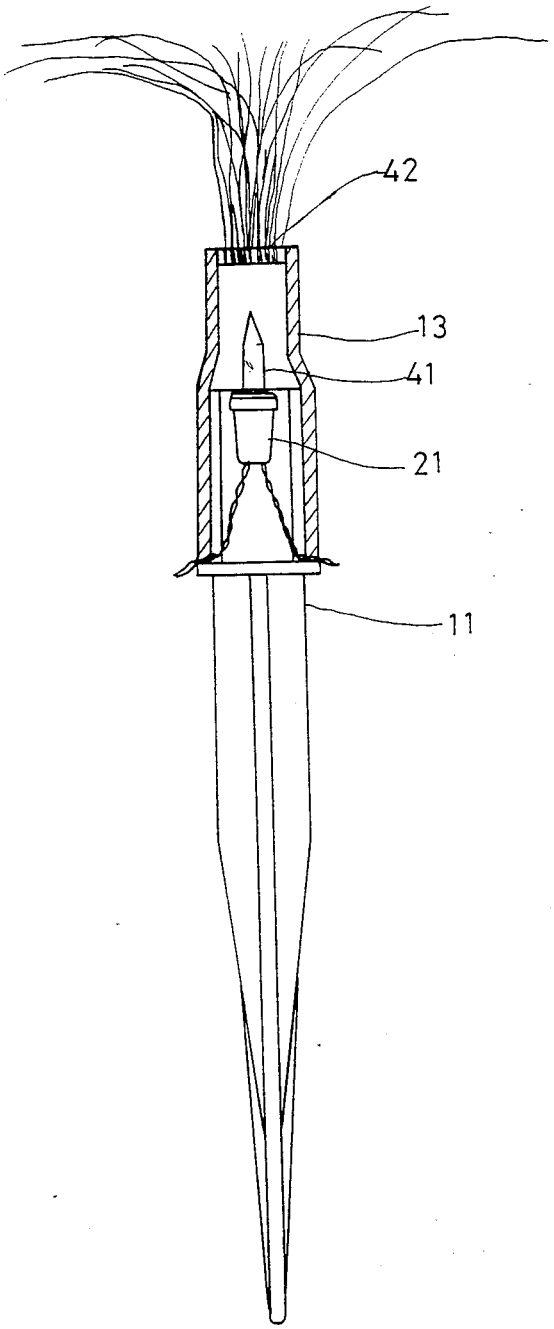
FIG. 7 is a diagram showing the location of a light conductive article made of optical fibers or other light transmitting materials onto the tubular fixing mount.
Figure 8:
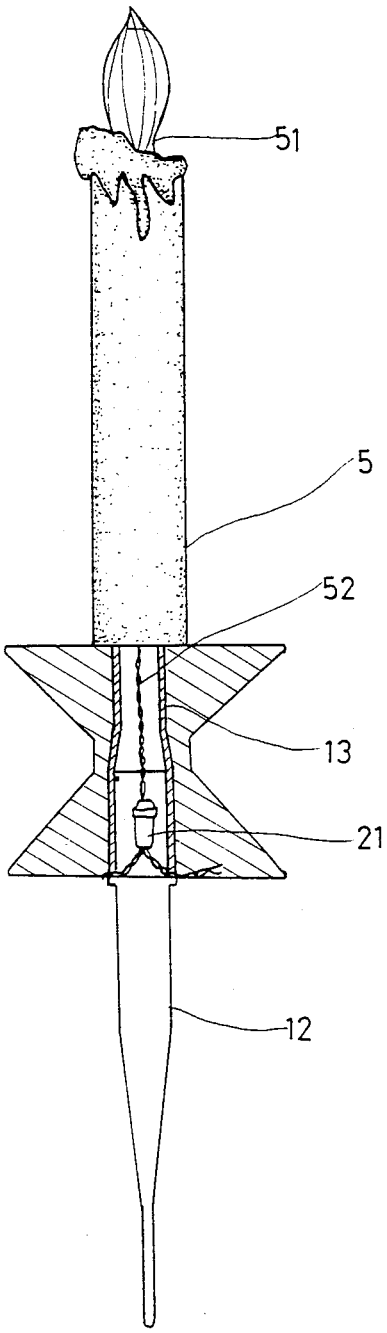
FIG. 8 is a diagram showing an electrically operated candle being secured to the tubular fixing mount.

Referring to FIGS. 7, 8, the present invention is characterized by its easy transformation into various forms by simply replacing the tubular holder with an electrically operated candle stick 5 which is securely mounted to the tubular fixing mount 13 by engaging the base thereof with the fixing mount 13. The candle stick 5 is provided with an extended male plug so that the same can be electrically coupled to one of the parallelly connected female sockets 35. A light conductive article 42 made of optical fibers or other light transmitting materials in various forms can be inserted into the tubular fixing mount 13 with a light bulb 41 serving as an illumination source, so that colorful optical effects can be produced accordingly.

Figure 4:
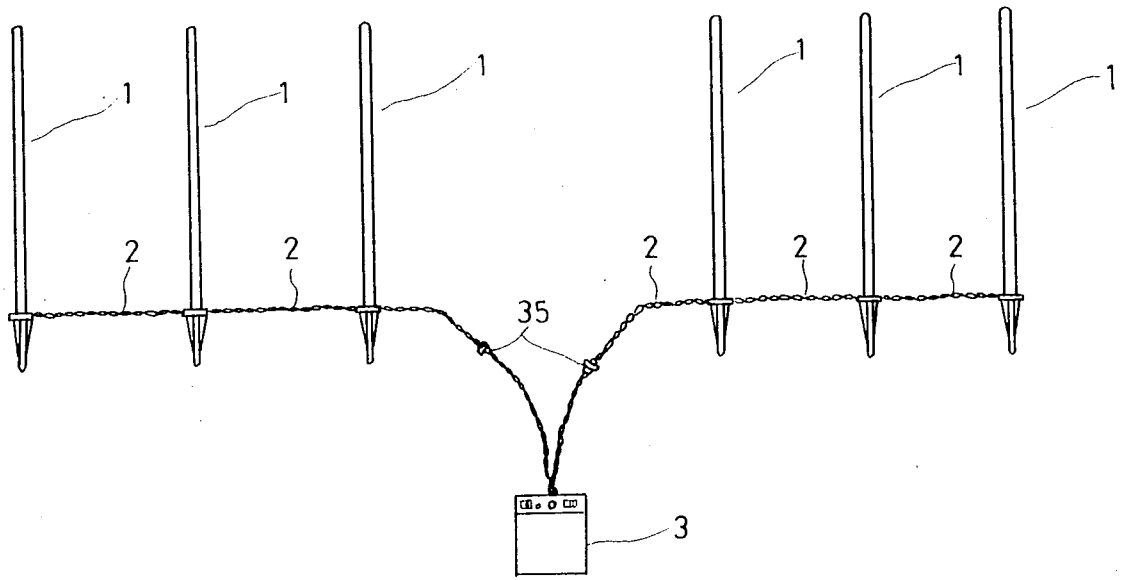
FIG. 4 is a diagram showing the arrangement of the present light decoration assembly.
Figure 5:
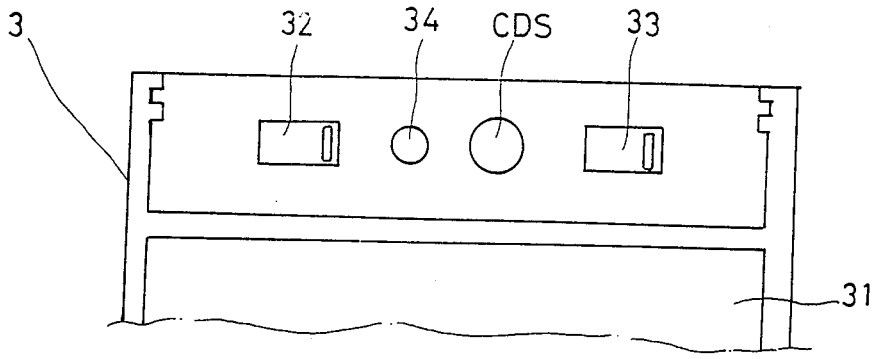
FIG. 5 is a diagram showing the control buttons disposed on the battery box with an adapter jack located adjacent thereto.

To facilitate the present invention to operate in AC or DC, a battery box 3, as shown in FIGS. 1, 4, is adapted. On the box there are disposed a number of selection buttons 32, 33 and a CDS and an adopter jack 34, permitting the present invention to be selectively operated either in a steady burning state or a one way flash state; and be controlled either by CDS or manually simply by setting proper buttons.

As shown in FIG. 1, 1B, 3, the ground fixing member 11 is provided with a number of reinforced ribs 41 on the peripheral wall thereof so that the same can be forced into the ground without being easily broken.

Figure 6:
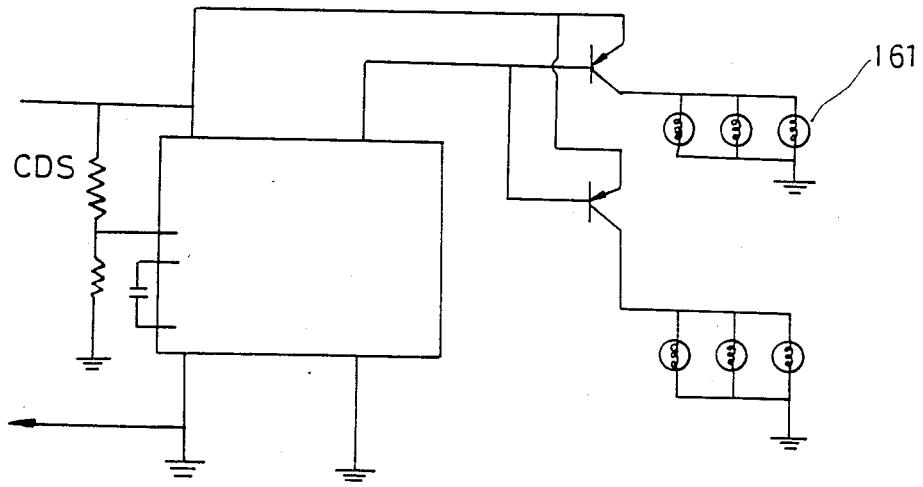
FIG. 6 is a diagram showing the electric circuit of the present invention.

A support base 17 having a circular flat bottom 172 engageable with the ground fixing member 11 is used to facilitate the location of the present light decoration assembly on the floor. Referring to FIG. 6, the light strings and the female sockets of the presnet invention are arranged in a parallel manner, thus the maintenance thereof can be performed with ease and the operation thereof can be ensured.

I claim:

1. An indoor/outdoor light decoration assembly comprising:

a number of light strings each consisting of a number of light bulbs electrically connected to each other in parallel with a male plug disposed at the end thereof;

a corresponding number of transparent tubular holders in which said light strings are respectively located with a top cap means engaged with the top end and a seal cover having a pair of symmetric vertical grooves disposed thereon attached at the bottom end thereof for the passage of electric wires therethrough;

a battery box having an on/off switch being provided with a pair of strings of female sockets electrically connected to each other in parallel;

a tubular fixing mount engaged with the end of each said tubular holder being defined to have two sections with different diameters; and a pointed ground-fixing member provided with reinforced ribs on the wall thereof so to prevent the same from being easily broken in operation, and a projected tubular element with a pair of grooves disposed thereon for the passage of electric wires therethrough and said fixing mount being engaged with said ground-fixing member; whereby said tubular holders, with said light strings located therein and the male plugs engaged with said strings of female sockets and said female sockets being stuffed into the bottom end of said tubular holders with said seal cover in registry with the same end, are engaged with said tubular fixing mounts which are coupled to said ground fixing members respectively so as to permit the light strings to be planted on the ground.

2. An indoor/outdoor light decoration assembly as claimed in claim 1 wherein said battery box is provided with a number of selection buttons and a CDS and an adapter jack so that the light decoration article can be operated in a steady burning state or a one way flash state; and be controlled to operate by CDS or manually; and be operated by DC or AC power source.

3. An indoor/outdoor light decoration assembly as claimed in claim 1 wherein said tubular fixing mount permits a light conductive article made of optical fibers or other light transmitting materials to be engaged therewith; or an electrically operated candle stick is able to be secured to said fixing mount by way of its candle case.

4. An indoor/outdoor light decoration assembly as claimed in claim 1 wherein said transparent tubular holders are made to have a plurality of axial ribs disposed on the wall thereof so as to improve the illumination effect.

5. An indoor/outdoor light decoration assembly as claimed in claim 1 wherein said light strings and said strings of female sockets are all electrically connected in parallel manner so that the same can be maintained in operation state even with one element thereof being out of function.

6. An indoor/outdoor light decoration assembly as claimed in claim 1 wherein each said transparent tubular holder is provided with a mushroom-shaped top cap and a bottom seal cover so as to guard the same from being penetrated with snow or rain when exposed in the outdoor field.

7. An indoor/outdoor light decoration assembly as claimed in claim 1 wherein a support base having a round flat bottom is removably engaged with said ground fixing member so that the assembly can be placed on the indoor floor.

* * * * *